US005217057A

United States Patent [19]

Hubbard et al.

[11] Patent Number: 5,217,057

[45] Date of Patent: Jun. 8, 1993

[54] STANDARD DIMENSION CURTAIN HANGER APPARATUS AND PROCESS FOR VARIABLE HEIGHT CEILING

[75] Inventors: Marvin R. Hubbard, Castro Valley; Wallace I. Resh, San Francisco, both of Calif.

[73] Assignee: Unicube USA, Inc., Oakland, Calif.

[21] Appl. No.: 637,409

[22] Filed: Jan. 4, 1991

[51] Int. Cl.[5] ..... A47H 5/00

[52] U.S. Cl. ..... 160/345; 160/123

[58] Field of Search ..... 160/123, 124, 126, 332, 160/341, 345

[56] References Cited

U.S. PATENT DOCUMENTS 1,750,445 3/1930 Vallen ..... 160/126 X
3,105,543 10/1963 Nolan ..... 160/346
3,983,921 10/1976 Ford ..... 160/341
4,648,436 3/1987 Oskam ..... 160/168.1
4,793,399 12/1988 Pryor ..... 160/345

*Primary Examiner*—Carl D. Friedman
*Assistant Examiner*—Derek J. Berger

[57] ABSTRACT

A suspended curtain system adaptable to non-uniform height ceilings having modular curtain panels suspended from a plurality of hangers, each hanger selected from an assortment of prefabricated lengths and is attached to roller mounted carriers supported in a track mounted to the ceiling to allow easy positioning of the suspended curtains by applying a horizontal force to the panels, the carriers are connected together by carrier links to reduce jamming of the carriers as they are moved around the track, the length of each hanger selected being sized to suspend the panels from the ceiling at a constant distance above the floor regardless of ceiling height.

6 Claims, 3 Drawing Sheets

STANDARD DIMENSION CURTAIN HANGER APPARATUS AND PROCESS FOR VARIABLE HEIGHT CEILING

This invention relates to curtains and curtain hangers. More particularly, a curtain hanging apparatus and process is disclosed which is especially adaptable to a system of uniform size curtain panels utilized for hospitals for securing privacy in spaces lacking partitions.

BACKGROUND OF THE INVENTION

Cubicle curtains are commonly used in medical facilities such as hospitals as visual barriers to provide privacy for patients. For example, semi-private hospital rooms are often divided up into multiple patient spaces using curtains. Therefore, the curtains used in medical facilities are usually suspended from the ceiling on roller tracks to allow quick and easy positioning for access. Suspended curtains are commonly hooked to carriers or rolling carrier cars positioned on ceiling mounted tracks. Using this type of installation, the curtains can be quickly and easily swept aside or repositioned without the use of draw strings.

Suspended ceiling curtains are used in all areas of hospitals including hospital bedrooms, wards, operating rooms and emergency rooms. A problem arises, however, when ceiling height is not uniform from room to room or in a given room. When the ceiling height varies, so must the length of the hanging curtain. Otherwise, in rooms having non-uniform ceiling height, curtains will hang unevenly. As a result, several curtains of different height may have to be used together to effectively partition a particular space. Two alternative methods are available for solving the problems associated with suspending curtains from non-uniform height ceilings.

One alternative would be to have custom curtains fabricated for the particular space to be partitioned given the ceiling height characteristics. This alternative is unattractive for two reasons. First, the cost of custom curtains is often prohibitive. Second, once fabricated, the custom curtain would only be suitable for the particular location it was designed for.

A remaining alternative is to use so-called "curtain drops."

Curtain drops in the prior art are known. Typically, they have been provided in standard dimensions—usually 16 or 18 inches of length. These drops depend from the suspending car and track at the upper end to the point of attachment to the curtain panels at the lower end.

Unfortunately, suspending curtains by drops from ceiling tracks is often complicated by jams and entanglements of the curtains as the curtains are pulled around in their particular track. Typical ceiling mounted tracks are I-beam or "U"-shaped, with the opening in the "U" being exposed downwardly toward the curtain suspended below. Carriers are then positioned inside the ceiling track. Usually, the tracks employed are not straight. Rather, the tracks have curved sections which allow the curtains to be pulled around corners.

It is when the curtains are pulled that jamming of the curtain supporting carriers frequently occurs. As the suspended curtain is pulled, the carriers above lag and/or lead the motion of the curtain below in varying amounts. This causes the carriers to bind amongst themselves.

This binding is particularly aggravated at the corners of the track—where the track curves—usually around the corner of a dimension of a bedding space or other area curtained for privacy within a hospital.

As a partial solution to binding, carrier have in the past been chained one to another. Typically, the incremental length of this chaining together has the same side-to-side spacing at the supporting cars as the below side-to-side spacing between the supporting grommets in the curtain. This solution allows the carriers to follow one another in the expanded overhead disposition just as the curtain is pulled below the curtain drops in an expanded underlying disposition.

DISCOVERY

Through experience we have discovered that entanglements and consequent jamming of the drop suspended curtains from their carriers still results. One common form of jam has been the tendency of the chain spacing the cars to become entangled with respect to the carrier depending hooks and the depending drops, especially when the curtain is jerked in rapid motion or pulled around corners. When such jamming occurs, the entire curtain pulls in the collapsed or folded disposition in an unsightly mass in following relation to the curtain.

This tendency has not been discussed or set forth in the prior art.

SUMMARY OF THE INVENTION

The curtain system comprises overhead tracks which are secured to the ceiling by roller mounted curtain carriers or cars following the tracks. An upper hook includes an upper hook portion threaded to the overlying track following car. The lower hook portion of the lower hook threads to two separate members. These members are the car connecting chain and the curtain supporting drop. The lower hook member is threaded at its upper hook portion to the lower portion of the drop and at its lower hook portion to the panel suspending grommet on the curtain. When curtain panels are overlapped to tailor horizontal partition dimensions, one or more hangers may support the suspension points of two curtains.

A specialized curtain hanger hook is disclosed for use in both locations under each track mounted car; these locations include the upper hook connecting the car and curtain drop and the lower hook connecting the curtain drop and curtain. The hook disclosed is elongate with an upper hook portion forming a first upper elongate portion of the hook, a lower hook portion forming a second lower elongate portion of the hook, and an initial gap between the upper and lower hook points permitting threading of the hook with the components of the curtain system.

The specialized hanger hook is preferably narrowed in the center to impart a hour glass dimension to the hook between the elongate hook portions. Initial fabrication of the hook has the upper hook at its hook point out of alignment with the lower hook at its hook point. Preferably, the upper hook point is more inwardly disposed towards the elongate loop of the hook; the lower hook point is more outwardly disposed from the elongate loop of the hook.

For each curtain car, typically two identical hooks are utilized; these hook members include an upper hook connecting the car, connecting chain between cars, and the depending curtain drop and a lower hook member connecting the depending curtain at the connecting grommet from the drop.

Typically, the upper hook member is initially threaded at its upper hook portion to the car. Thereafter, the car connecting chain and then the drop are threaded to the lower hook portion of the upper hook so that the weight of the drop firmly holds the lighter chain to the lower portion of the upper hook. Finally, the lower hook portion is bent. Bending occurs to confront and close the upper hook portion point and the lower hook portion point. Closed and permanent assembly of the upper track mounted cars, hooks, drops and car connecting chains results.

Use of the lower hook member is conventional; the upper hook portion is threaded to the lower portion of the drop and the lower hook member is threaded to the grommet suspending the curtain. Optimally, the upper hook portion is bent to permanently close about the drop. Most importantly, the identical hook member serves both connections.

The system uses universal modular curtain panels of a single standard height and width applicable to any variable height ceiling by providing a selectable length drops for suspending the panels. By varying the length of the drops, the present invention allows standard sized universal curtain panels to be suspended from non-uniform height ceilings at a uniform distance from the floor.

Additionally, by using standard universally sized modular curtain panels, the inventory of replacement curtains and the logistics of cleaning and storing curtains is much simplified over alternative systems.

DESCRIPTION OF THE PREFERRED EMBODIMENT

Figure 1:
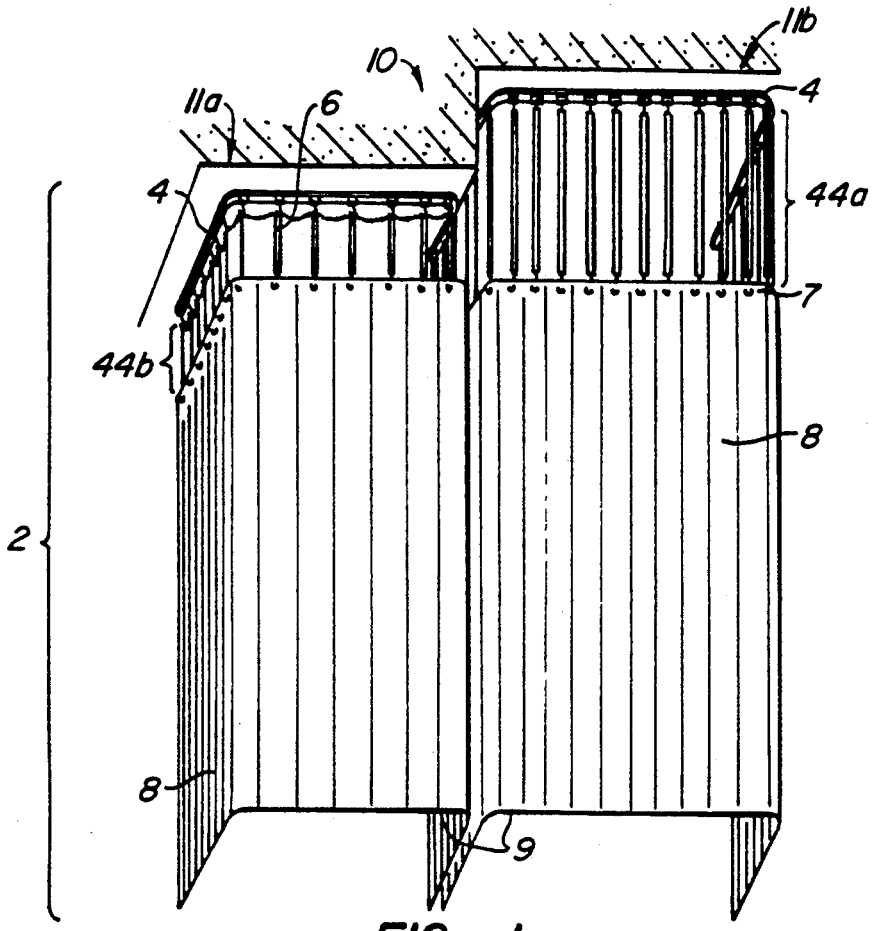
FIG. 1 is a perspective view of a two panel hospital curtain system in accordance with this invention with curtain suspension occurring from a ceiling having non-uniform height.

FIG. 1 illustrates the suspended curtain system 2 affixed to a ceiling 10 having non-uniform height represented by the two surfaces 11*a* and 11*b*. The suspended curtain system has a track 4 secured to the ceiling 10 by appropriate means depending upon the construction of the ceiling. The track can be secured to the ceiling using adhesive, screws, nails or other appropriate means. The track 4 can be constructed of steel, aluminum, plastic, or other suitable rigid material. In the preferred embodiment, aluminum is used.

Figure 3:
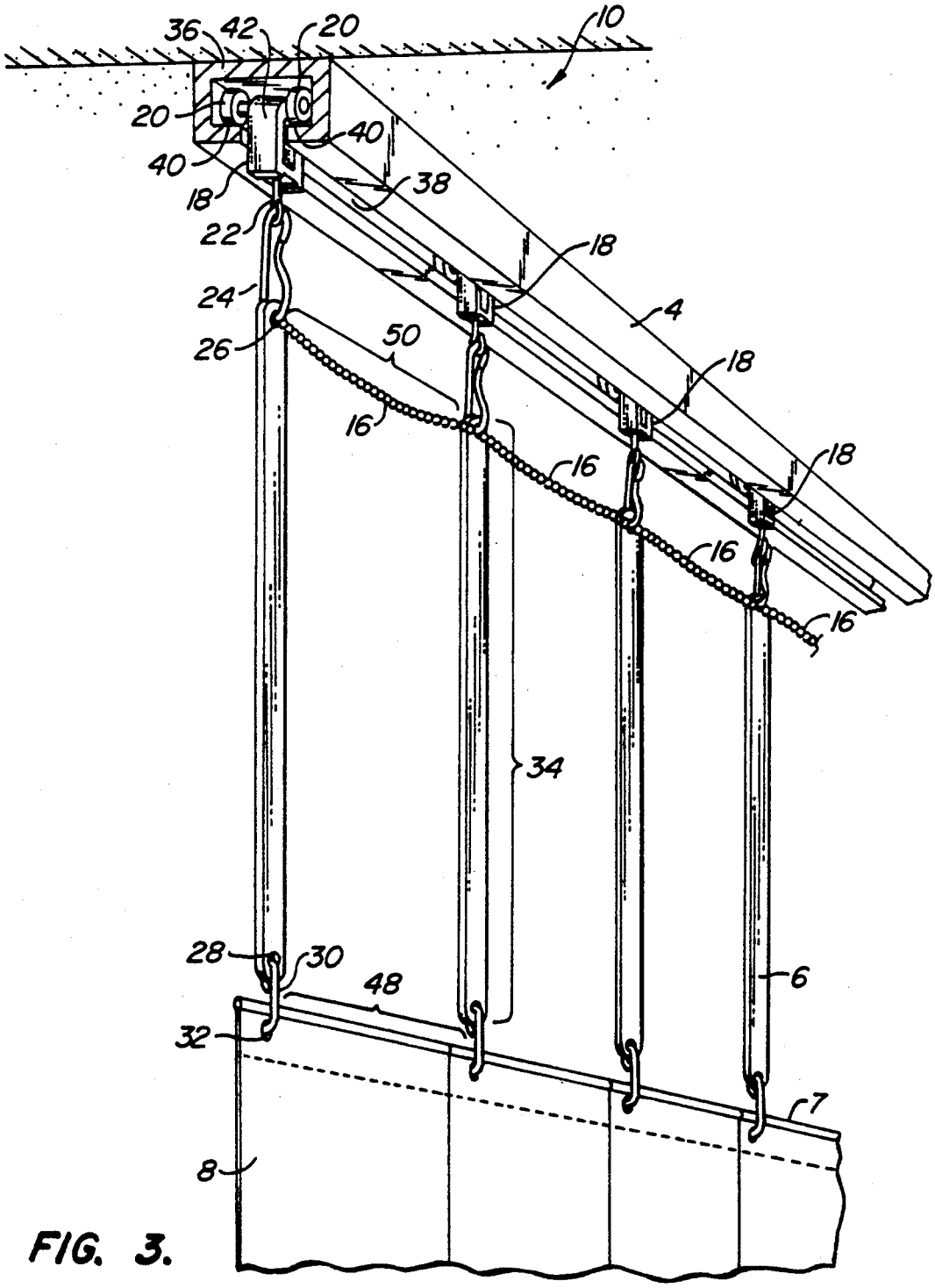
FIG. 3 is a detailed perspective view of the suspended curtain system showing a cross section of the track, a series of curtain suspending cars each connected to a drop through an upper hook, with the upper hooks in turn connected by chains for the spacing of the series connected drops, and the series connected drops supporting at their lower ends through lower hooks the curtain panels; and, FIG. 4A is an enlarged side elevation of the preferred hook member used at the upper and lower hooks underlying each car.

Referring now to FIG. 3, a straight section of curtain suspending track is illustrated with the preferred construction of the invention. Track 4 has a substantially rectangular cross-section 36 with an open track channel 38 at its lower surface. A plurality of carriers 18 are disposed inside the track 4. Each carrier 18 comprises wheels 20 rotatably secured to a carrier body 42 which extends downwardly through the track channel 38. In the preferred embodiment, two wheels are used with each carrier. To practice the invention, however, any number of wheels could be used to accomplish the function of roller mounting the carrier.

The wheels 20 rest upon a support surface 40 inside the track 4. The dimensions of the track 4 are such that the carrier 18 has minimal lateral movement from side to side and up and down within the track 4, but is free to roll along the support surface 40 in either direction parallel to the axis of the track 4. A carrier eyelet 22 is swiveled mounted to the lower portion of each carrier body 42 and is secured to upper hook 24 which depends downwardly from the carrier eyelet 22. A drop 6 is dependently mounted to upper hook 24 at an upper attachment point 26. The hanger 6 also has a lower attachment point 28 where lower hook 30 is secured. The lower hook 30 is removably inserted into a curtain panel suspension grommet 32 located near the upper edge 7 of a modular curtain panel 8. Non-rigid carrier links 16 connect adjacent pairs of upper hooks 24. These hooks serve to link the cars at the upper ends of the drops 6. As is seen in the illustration of FIG. 3, when the curtain is pulled cars 18 follow in overlying serial spaced apart relation to the underlying spaced apart relation of grommets 32 on curtain panel 8.

The roller mounting of the carriers 18 within the track 4 allows the modular curtain panels 8 to be positioned in any desired configuration along the track 4. The curtain panels can be positioned in a retracted or closed configuration as shown in FIG. 2 or in an open configuration as shown in FIG. 3.

Figure 2:
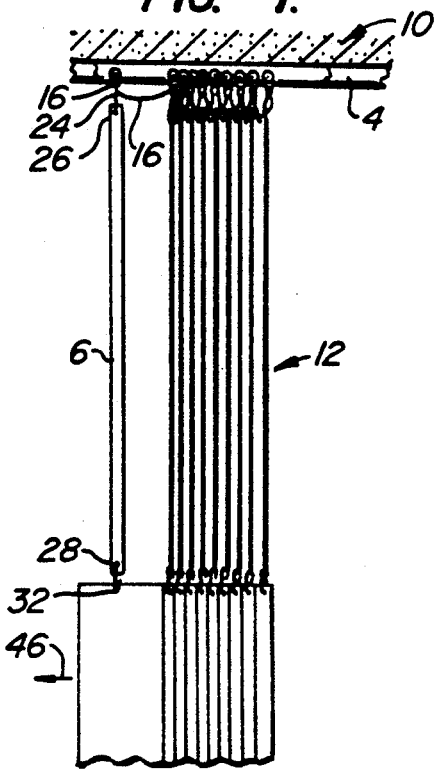
FIG. 2 is an illustration of the top portion of the suspended curtain system showing the curtain being initially pulled open from a retracted position, the track being shown partially cut-away to see the carriers.

FIG. 2 shows the suspended curtain system 2 in a retracted condition where the carriers 18 are in close proximity to one another. When in the fully retracted position, the horizontal space taken by the suspended modular curtain panels 8 is compressed to remove visual barriers or facilitate access. The suspended curtain system 2 can be opened from the retracted position by pulling on the modular curtain panel 8 as depicted by horizontal force. As the curtain panel 8 is pulled, the horizontal force 46 is transferred to the carrier 18 through the upper hook 30, the hanger 6, the lower hook 24 and finally to the carrier grommet 22. As the horizontal force 46 is transferred to the carrier 18, the carrier rolls along the support surface 40 of the track 4. A non-rigid carrier link 16 connects each pair of adjacent carrier hooks 24. Preferably, carrier link 16 is attached to each carrier hook 24 on the inside of the carrier hook 24 relative to hanger 6. As such, hanger 6 helps prevent carrier link 16 from sliding off carrier hook 24. The horizontal length of the carrier link 16 is equal to the horizontal distance between each pair of adjacent suspension points 32 located on the curtain panel 8. Therefore, as the curtain panel 8 is pulled by a horizontal force 46, the maximum horizontal spacing between adjacent carriers is restricted such that the hangers 6 remain substantially parallel.

When the suspended curtain system 2 is opened from a closed position, the carrier links 16 in conjunction with the hangers 6 transfer the horizontal component of the pulling force 46 along each carrier 18 consecutively until the curtain panel 8 is pulled extended to the desired open condition as depicted in FIG. 3. The wheels 20 of the carriers 18 allow the modular curtain panel to be positioned anywhere along the track 4 in a fully open condition, a fully closed condition, or any condition therebetween.

In the preferred embodiment of the invention, the track 4 is fabricated from lightweight aluminum and secured to the ceiling using appropriate means. The track 4 can be installed using several pieces of straight and curved sections end-to-end to achieve a desired path where the suspended curtain panels 8 will partition the space below the ceiling as desired. Numerous curtain panels 8 can be used together to define and partition large spaces. For example, multiple universally sized curtain panels B, such as panels having dimensions of 68"×68" can be used to define any space. Curtain panels 8 can be overlapped along their width to tailor horizontal distance to be partitioned to the particular horizontal dimensions where the suspended curtain system is installed.

Having set forth the general construction of the curtain apparatus, the specialized hook construction can now be described.

Figure 4A:
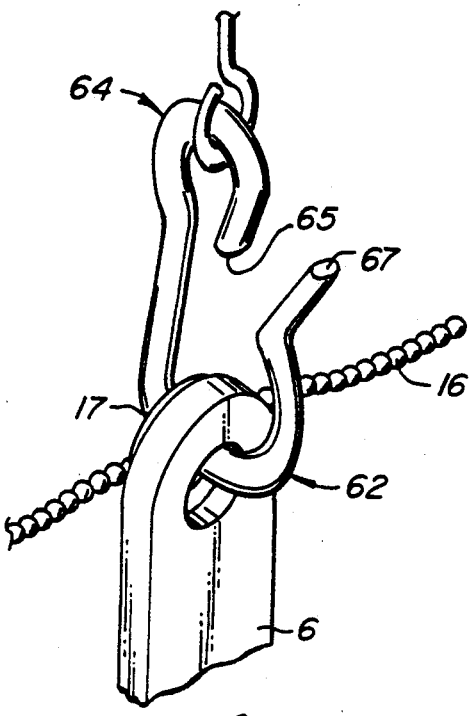
FIG. 4B is a detail, reduced in scale from the view of FIG. 4A, illustrating the upper hook threaded at the upper hook portion to the car and threaded at the lower hook portion of the car connecting chain and depending drop; and, FIG. 4C is a detail on a scale similar to FIG. 4B illustrating the closing of the upper and lower hook portion points by the bending of the lower hook portion for the closing of the loop with confrontation of the two hook points.
Figure 4A:
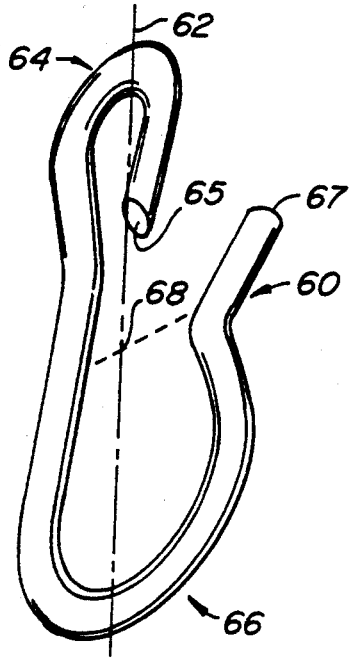

Referring to FIG. 4A, hook 60 forming the preferred embodiment of this invention is disclosed. The hook is of bendable wire construction and is elongate about a major axis 62. Hook 60 includes an upper hook portion 64 opening at a hook point 65. Hook 60 further includes a lower hook portion 66 opening at a hook point 67.

The elongate hook can be described as being of an hourglass shape. Thus the hook defines between upper hook portion 64 and lower hook portion 66 a narrowed section 68. Section 68—having a width less than upper hook portion 64 and lower hook portion 66 imparts a distinctive hourglass shape.

Finally, it will be observed that the respective hook points 65, 67 are offset. This construction enables the hook to meet two requirements. First, upper hook portions 64 and lower hook portion 66 can be individually threaded. This is illustrated with respect to FIG. 4B.

Figure 4B:
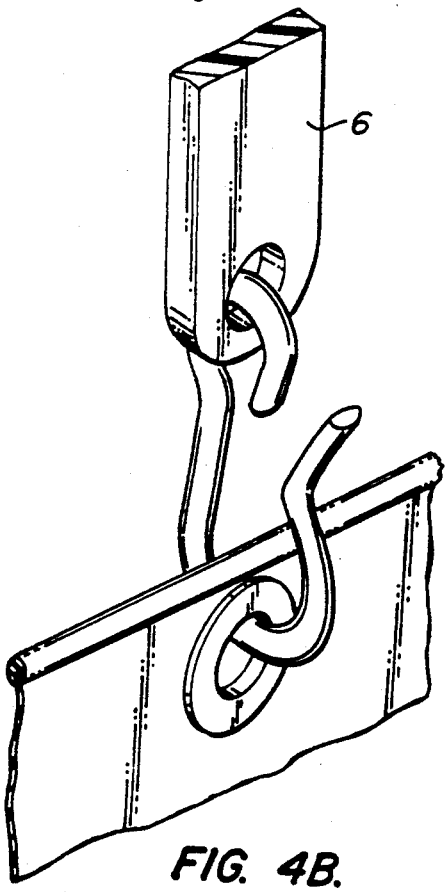
Figure 4C:
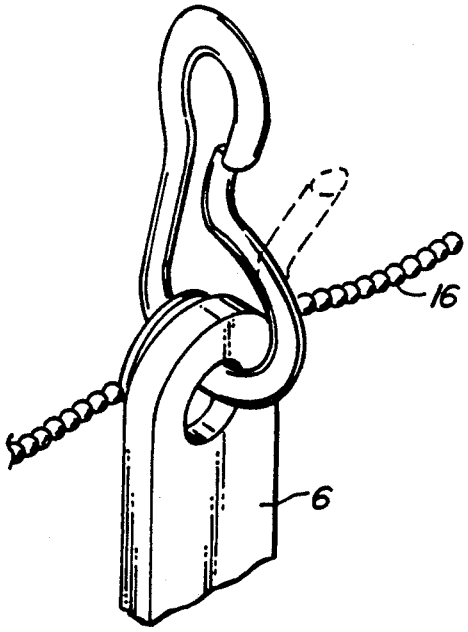

Secondly, once threaded, the individual hook portions can be closed. Specifically, and as illustrated in FIG. 4C, bending of lower hook portion 66 inwardly to close gap 68 causes lower hook portion point 67 to move into registration with upper hook portion point 65. When this registration occurs, all members threaded to the hook 60 are effectively permanently captured to the hook 60.

The reader must understand that this result is not trivial. First, utilizing the hook of the disclosed construction, installation becomes both simplified and permanent in so far as the installer is concerned. Simply stated—and as illustrated in FIG. 4B, the installer first threads point 65 of upper hook portion 64 to the car. Thereafter, lower hook portion 66 is threaded preferably first with chain 16 at loop 17 and secondly with drop 6—it being noted that for the short period of time that hook 60 remains open drop 6 holds chain 16 at loop 17 firmly in place. Thereafter, hook 60 is closed by simple bending of the lower hook portion 66 to confront points 65, 67.

Stopping at this juncture, it will be seen that a permanent upper curtain assembly has been fabricated. Specifically, cars 18, upper hooks 24, chains 16, and the depending drops 6 are all formed in a unitary, rigid assembly. What remains is the removable of curtain 8 at grommets 32, which is conventional.

With the preferred hook construction of this invention, the hook member 60 may again be used for lower hook 30. Specifically, upper hook portion 64 is threaded at point 65 to the lower portion of drop 6. Preferably, slight bending of point 65 inward effects permanent attachment lower hook 30 to drop 6. Lower hook portion 66 is left open at point 67. Curtain panels 8 can be removably detached at grommet 32.

While preferred embodiments have been set forth, various modifications, alterations and changes may be made without departing from the spirit and scope of the present invention as defined in the appended claims.

What is claimed is:

1. A curtain system for defining visual living space barriers over an open floor from a ceiling mounted track, said system including:

an overlying ceiling mounted track having a support surface;

at least two curtain carriers, said carriers comprising a body portion and roller means rotatably mounted to said body for mobile positioning of said carrier within said track, said support surface supporting the curtain carriers at the roller means;

at least one modular curtain panel, said modular curtain panel having constant vertical height and a plurality of uniformly spaced suspension points along the upper edge of said panel;

a plurality of solid curtain drops comprising a rod having an upper end and a lower end, said rod having means for threaded attachment at said upper end and having means for threaded attachment at the lower end, a plurality of carrier links, said carrier links comprising tensile members for providing linkage under tension between points for threading to adjacent pairs of said carriers when positioned in said track and permitting said carriers to move towards and away from one another relative to one another, said linkage under tension having a maximum horizontal dimension equal to the maximum horizontal dimension between adjacent pairs of support points along the upper edge of the panels whereby said curtain carriers are linked in uniform spaced apart relation when pulled with a horizontal force, said spaced apart relation corresponding to the uniform spaced apart relation of said suspension points on said curtain panels to enable curtain movement of said suspended modular curtain panels over said floor and under said track;

an upper carrier hook elongate about a vertical axis, said hook comprising an elastical and deformable member defining an upper hook portion at the upper portion of said elongate hook and a lower hook portion at the lower end of said elongate hook;

said hook defining along one of said elongate sides first and second hook points to permit the threading of said hook portions with members to be bound to said hooks;

said hook points initially offset one with respect to the other to permit said hook to be threaded;

said upper hook portion of said elongate hook threaded to said carrier through said upper hook point;

said lower hook portion of said elongate hook threaded to said drop at said upper end and to at least one end of one of said carrier links at said lower end; and, said hook at one of said elongate portions deformed to confront one another to capture said threaded carrier, drop and carrier links to said hook and exclude other members from being entangled to said hook.

2. The curtain system of claim 1 and wherein:

said elongate hook member is narrowed between said upper hook portion and said lower hook portion to impart to said hook an hour glass shape.

3. The curtain system of claim 2 and wherein:

said hook points are defined above the narrowed portion of said elongate hook.

4. The curtain system of claim 2 and wherein:

said provided elongate hook member has said hook points defined above the narrowed portion of said elongate hook.

5. A method of installing the suspended curtain system of claim 1 on a non-uniform height ceiling comprising the steps of:

securing the track to a ceiling in a desired position to define the space below the ceiling to be partitioned by the suspended curtain system;

placing a plurality of carriers on said track, said carrier having points for threading to a curtain assembly there below;

selecting a solid curtain drop with a desired length for each of said support points such that when the drop is suspended from the carrier at the upper end and the drop is attached to each curtain panel at the lower end, the curtain panel is suspended at a desired uniform distance from the floor;

providing a plurality of carrier links, said carrier links comprising tensile members for providing linkage under tension between points for threading to adjacent pairs of said carriers when positioned in said track and permitting said carriers to move towards and away from one another relative to one another, said linkage under tension having a maximum horizontal dimension equal to the maximum horizontal dimension between adjacent pairs of support points along the upper edge of the panels whereby said curtain carriers are linked in uniform spaced apart relation when pulled with a horizontal force, said spaced apart relation corresponding to the uniform spaced apart relation of said suspension points on said curtain panels to enable curtain movement of said suspended modular curtain panels over said floor and under said track;

providing an upper carrier hook elongate about a vertical axis, said hook comprising a elastica and deformable member defining an upper hook portion at the upper portion of said elongate hook and a lower hook portion at the lower end of said elongate hook, said hook defining along one of said elongate sides first and second hook points to permit the threading of said hook portions with members to be bound to said hooks, said hook points initially offset one with respect to the other to permit said hook to be threaded;

threading said upper hook portion of said elongate hook to said carrier through said upper hook point;

threading said lower hook portion of said elongate hook to said drop at said upper end and to at least one end of one of said carrier links at said lower end; and, deforming said hook at one of said elongate portions to confront said hook portion points one to another to capture said threaded carrier, drop and carrier links to said hook and exclude other members from being entangled to said hook.

6. The process of installing a curtain system of claim 5 and wherein:

said provided elongate hook member is narrowed between said upper hook portion and said lower hook portion to impart to said hook an hour glass shape.

* * * * *